US007198559B2

(12) United States Patent
Walstrum et al.

(10) Patent No.: US 7,198,559 B2
(45) Date of Patent: Apr. 3, 2007

(54) MODULAR SANDER-CASING ARCHITECTURE

(75) Inventors: Michael J. Walstrum, Columbia, MD (US); Stuart J. Wright, Timonium, MD (US)

(73) Assignee: Black & Decker, Inc., Newark, DE (US)

( * ) Notice: Subject to any disclaimer, the term of this patent is extended or adjusted under 35 U.S.C. 154(b) by 0 days.

(21) Appl. No.: 11/019,624

(22) Filed: Dec. 23, 2004

(65) Prior Publication Data

US 2006/0141915 A1 Jun. 29, 2006

(51) Int. Cl.
*B24B 27/08* (2006.01)

(52) U.S. Cl. ..... 451/270; 451/357

(58) Field of Classification Search ..... 451/344, 451/357, 355, 356, 358, 359, 270, 271, 159; 30/166.3

See application file for complete search history.

(56) References Cited

U.S. PATENT DOCUMENTS

| | | | | |
|---|---|---|---|---|
| 2,775,076 | A | 12/1956 | Roods | |
| 3,009,493 | A | 11/1961 | Dodegge | |
| 3,759,336 | A | 9/1973 | Marcovitz | |
| 4,854,085 | A * | 8/1989 | Huber | 451/357 |
| 4,893,436 | A * | 1/1990 | Rich | 451/442 |
| 5,033,552 | A | 7/1991 | Hu et al. | |
| 5,384,984 | A * | 1/1995 | Smith | 451/357 |
| 5,871,394 | A | 2/1999 | Mattson et al. | |
| 6,132,300 | A | 10/2000 | Martin | |
| 6,190,245 | B1 * | 2/2001 | Heidelberger et al. | 451/357 |
| 6,286,611 | B1 | 9/2001 | Bone | |
| 6,641,467 | B1 | 11/2003 | Robson et al. | |
| 6,855,040 | B2 * | 2/2005 | Huber | 451/357 |
| 2003/0017795 | A1 | 1/2003 | Walker | |
| 2004/0003503 | A1 | 1/2004 | McDonald | |

FOREIGN PATENT DOCUMENTS

| | | |
|---|---|---|
| EP | 0719616 | 3/1996 |
| WO | WO 01/94073 | 12/2001 |

OTHER PUBLICATIONS

European Patent Office Communication dated Feb. 9, 2006, for European Patent Application No. 05111909.7-2302.

* cited by examiner

*Primary Examiner*—Jacob K. Ackun, Jr.
(74) *Attorney, Agent, or Firm*—Harness, Dickey & Pierce, P.L.C.

(57) ABSTRACT

A sander-casing may include: a field housing to contain at least a motor, the field housing having an interface connectable to a random orbital sander (ROS) shroud and a quarter sheet sander (QSS) shroud. The ROS shroud can contain an ROS-type power transmission. The QSS shroud can contain a QSS-type power transmission.

25 Claims, 13 Drawing Sheets

MODULAR SANDER-CASING ARCHITECTURE

BACKGROUND OF THE PRESENT INVENTION

Two varieties of orbital palm sanders are typically encountered, namely a random orbit type of orbital sander (hereafter random orbit sander or ROS) and a quarter-sheet type of orbital sander (hereafter quarter-sheet sander or QSS). Each type has a motor connected to a power-transmission. A two-part clam-shell-type field housing contains the motor and a two-part clam-shell-type shroud contains the power-transmission.

Due to the different types of oscillation exhibited, the ROS and QSS power transmissions differ. Similarly, the ROS and QSS motors differ. As a result, the field housings for the RSS and for the QSS differ. And the shrouds for the RSS and the QSS differ.

SUMMARY OF THE PRESENT INVENTION

At least one embodiment of the present invention provides a sander-casing comprising: a field housing to contain at least a motor, the field housing having an interface connectable to (1) a random orbital sander (ROS) shroud, an ROS-type power transmission being containable therein, and (2) a quarter sheet sander (QSS) shroud, a QSS-type power transmission being containable therein.

At least one other embodiment of the present invention provides a method of manufacturing random orbit sanders and quarter-sheet sanders. Such a method may include: providing a sander-appropriate motor; encasing, at least partially, the motor in a field housing to create an at least partially assembled power unit; and stockpiling a plurality of the at-least-partially assembled power units, by iteratively repeating the steps of providing and encasing, without also stockpiling a corresponding number of sander-appropriate power-transmissions with which the plurality of at-least-partially-assembled power units can be mated.

Additional features and advantages of the present invention will be more fully apparent from the following detailed description of example embodiments, the accompanying drawings and the associated claims.

BRIEF DESCRIPTION OF THE DRAWINGS

The drawings are: intended to depict example embodiments of the present invention and should not be interpreted to limit the scope thereof. In particular, relative sizes of the components of a figure may be reduced or exaggerated for clarity. In other words, the figures are not drawn to scale.

DETAILED DESCRIPTION OF EXAMPLE EMBODIMENTS

In developing the present invention, the following problem with the Background Art was recognized and a path to a solution identified. As noted above, the ROS (again, random orbit sander) and QSS (again, quarter-sheet sander) power transmissions differ and the motors differ. Similarly, the Background Art casing components differ. More particularly, the field housings (to encase the motors) for the RSS and for the QSS differ, and the shrouds (to encase the power transmissions) for the RSS and the QSS differ. Each of the four casing components (two for the ROS, two for the QSS) represents one or more dedicated moulds which must be created as well as significant amounts of manpower needed to tune the respective component and its associated mould, which represents a problem in terms of cost.

In developing the present invention, it has been recognized that the substantially similar silhouettes of the ROS and QSS field housings might be susceptible to the use of a common field housing. If such a common field housing could be used for both the ROS and the QSS, then significant development and manufacturing savings could be achieved. In other words, development and manufacturing costs could be reduced by about 25% due to eliminating one of the four casing components. One or more embodiments of the present invention provide such a common field housing, and an ROS shroud and a QSS shroud each of which is connectable to the common field housing. To ensure a capacity to manufacture a given number of either ROS or the QSS, the one or more embodiments of the present invention enjoy the advantage of requiring a reduced inventory (as small as one-half the number) of field housings relative to the Background art. Similarly, the one or more embodiments of the present invention can enjoy a finer granularity of production control and/or a greater capability to conform with the general principles of just-in-time manufacturing.

Figure 1:
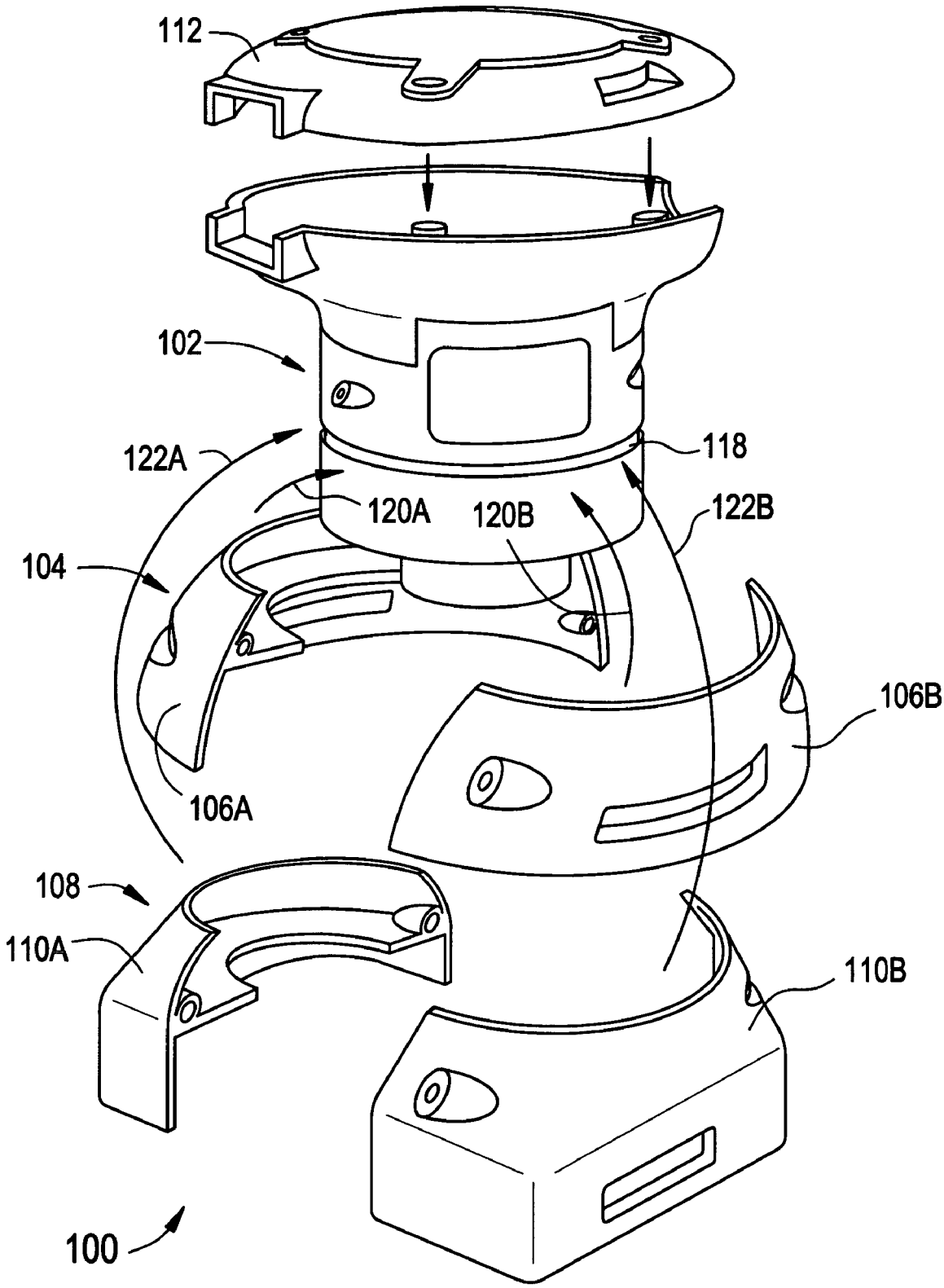
FIG. 1 is a three-quarter perspective exploded view of a modular sander-casing architecture, according to at least one embodiment of the present invention.

FIG. 1 is a three-quarter perspective exploded view of a modular sander-casing architecture 100, according to at least one embodiment of the present invention.

Sander-casing architecture 100 includes: a common field housing 102 to contain at least a sander-appropriate motor; a top cap 112 to be fitted onto field housing 102; an ROS (again, random orbit sander) shroud 104 to contain an ROS-type power transmission, where ROS-shroud 104 is connectable to field housing 102; and a QSS (again, quarter-sheet sander) shroud 108 to contain a QSS-type power transmission, where QSS-shroud 108 also is connectable to field housing 102. ROS-shroud 104 can be of clam-shell construction, which includes substantially mirror-symmetric halves 106A and 106B. QSS-shroud 108 can be of clam-shell construction, which includes substantially mirror-symmetric albeit truncated halves 110A and 110B. Halves 106A, 106B, 110A and 110B have a truncated depiction in FIG. 1 for simplicity of illustration; they are missing, e.g., dust discharge ports, etc.

Each of shrouds 106 and 108 is adapted to be connectable to field housing 102. For example, field housing 102 can include a circumferential groove 118 (to be discussed in more detail below) as part of a tongue-and-groove arrangement. Correspondingly, each of ROS-shroud 106 and QSS-shroud 108 can include a circumferential lip (to be discussed in more detail below) that serves as the tongue corresponding to groove 118 in the tongue-and-groove arrangement.

A casing for an RSS can be assembled by disposing RSS-shroud halves 106A and 106B against and around field housing 102 as indicated via arrows 120A and 120B, respectively. A casing for a QSS can be assembled by disposing QSS-shroud halves 110A and 110B against and around field housing 102 as indicated via arrows 122A and 122B, respectively.

Figure 2A:
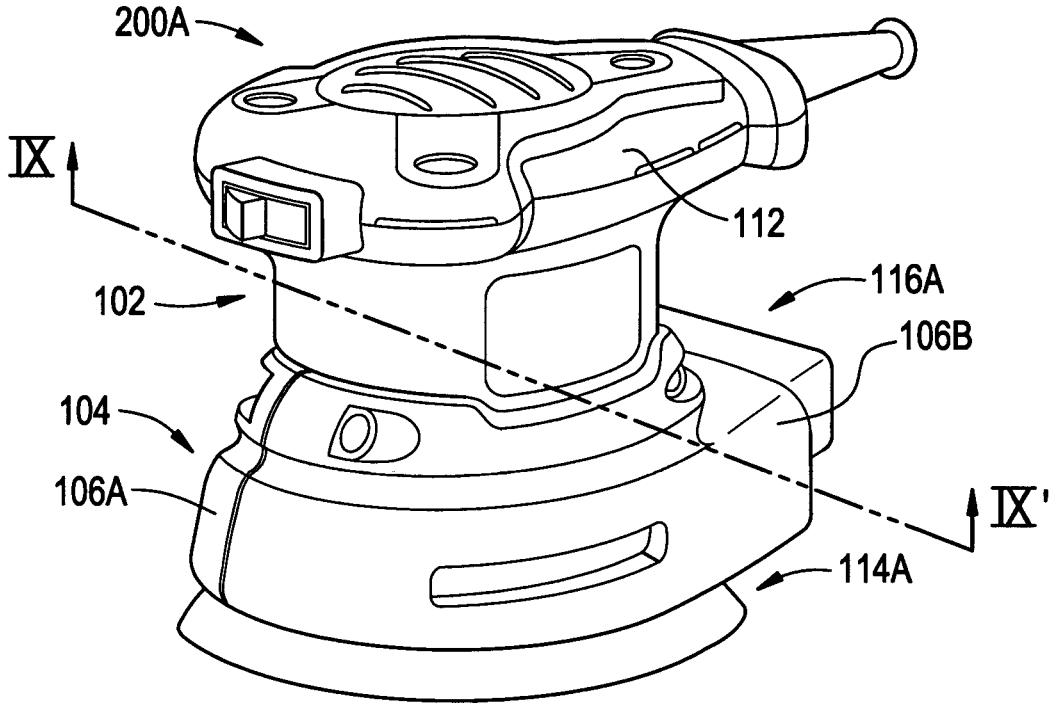
FIG. 2A is a three-quarter perspective view of an external configuration for a random orbital sander (ROS) casing, according to at least one embodiment of the present invention.

FIG. 2A is a three-quarter perspective view of an external configuration for a random orbital sander (ROS) casing 200A, according to at least one embodiment of the present invention.

ROS-casing 200A of FIG. 2A includes: top cap 112; halves 106A and 106B of ROS-shroud 104; and a round sanding platen 114A. A sandpaper disc (not shown) is supported by platen 114A. Platen 114A is, e.g., mounted via a central shaft bearing (not shown) of an ROS power transmission (not shown) and powered by a motor (not shown), etc. Platen 114A traverses an orbital path that is considered random relative to the substantially non-random orbital path traversed by a platen on a QSS sander. The depiction of shroud-halves 106A and 106B is less truncated (if at all) in comparison to FIG. 1 because, e.g., together their depiction includes a dust exhaust port 116A.

Figure 2B:
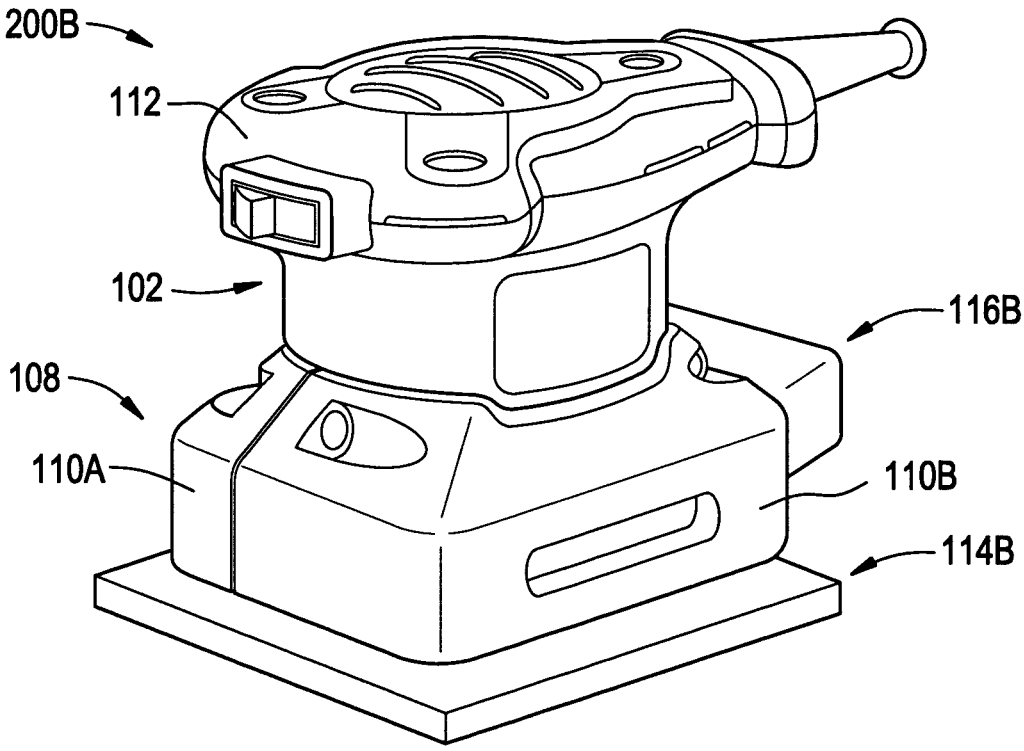
FIG. 2B is a three-quarter perspective view of an external configuration for a quarter-sheet sander (QSS) casing, according to at least one embodiment of the present invention.

FIG. 2B is a three-quarter perspective view of an external configuration for a quarter-sheet sander (QSS) casing 200B, according to at least one embodiment of the present invention.

QSS-casing 200B of FIG. 2B includes: top cap 112; halves 110A and 110B of QSS-shroud 108; and a rectangular sanding platen 114B. One quarter of a standard sheet of sandpaper (not shown) is supported by platen 114B. Platen 114B is mounted via a central shaft bearing (not shown) of a QSS power transmission (not shown) and powered by a motor (not shown), etc. Platen 114B traverses an orbital path that is considered non-random relative to the more-random orbital path traversed by a platen on an ROS sander. The depiction of shroud-halves 110A and 110B is less truncated (if at all) in comparison to FIG. 1 because, e.g., together their depiction includes a dust exhaust port 116B.

Figure 3A:
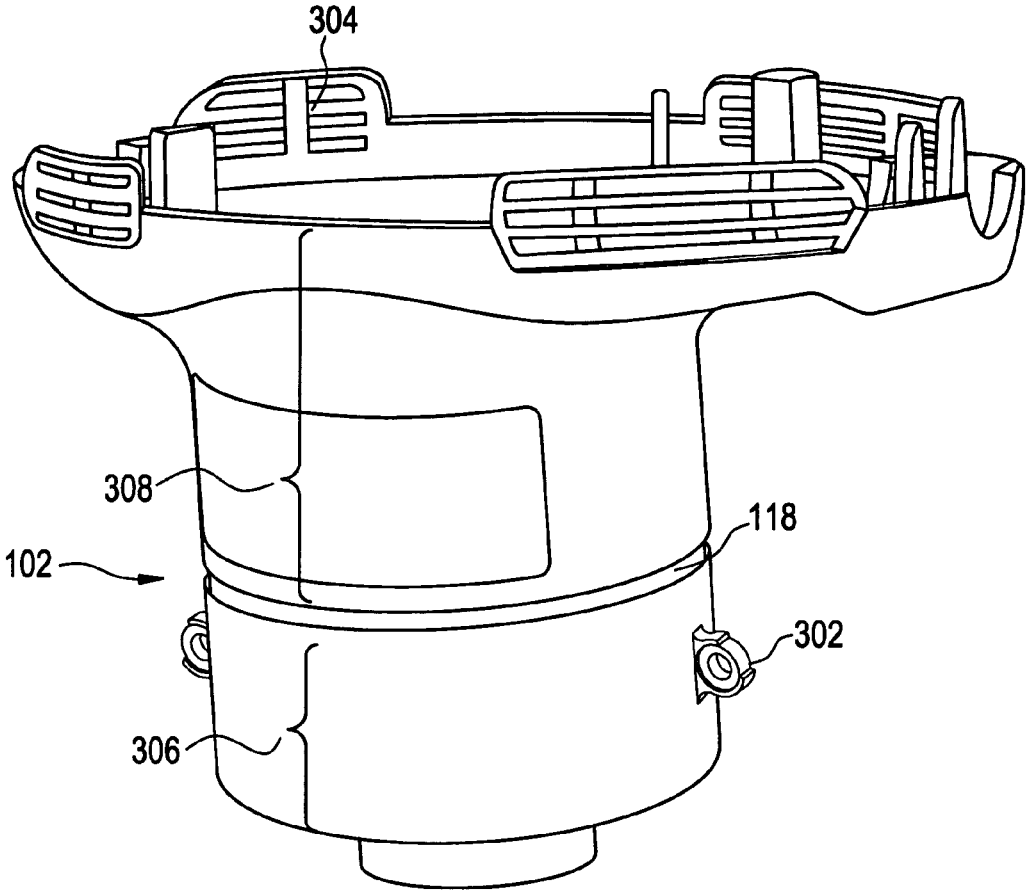
FIG. 3A is a side view showing the field housing of FIG. 1 in more detail, according to at least one embodiment of the present invention.

FIG. 3A is a side view showing field housing 102 in more detail, according to at least one embodiment of the present invention.

Figure 3B:
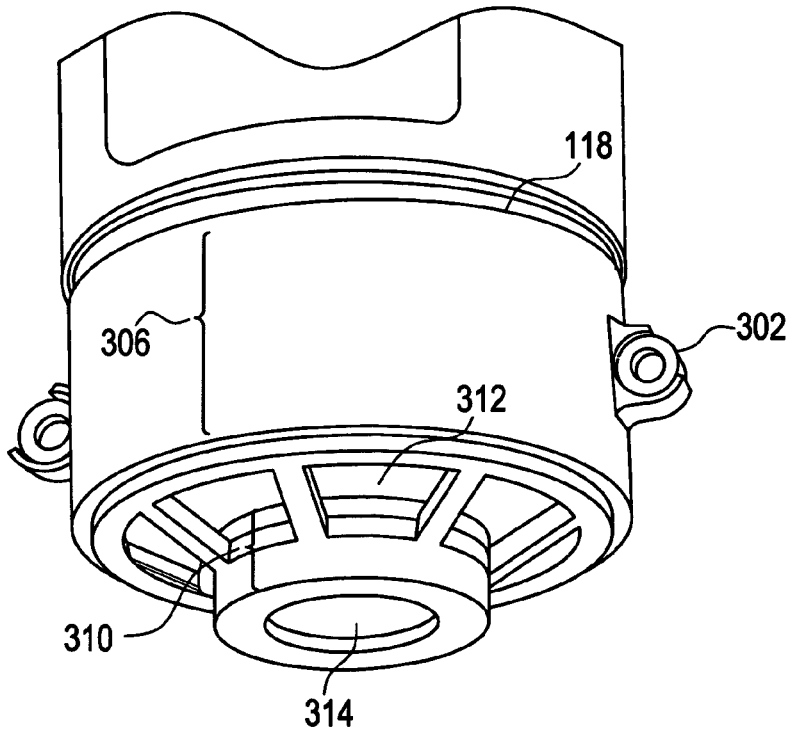
FIG. 3B is a three quarter perspective view showing the bottom portion of the field housing of FIG. 1 in more detail, according to at least one embodiment of the present invention.

FIG. 3B is a three quarter perspective view showing the bottom portion of field housing 102 in more detail, according to at least one embodiment of the present invention.

Figure 3C:
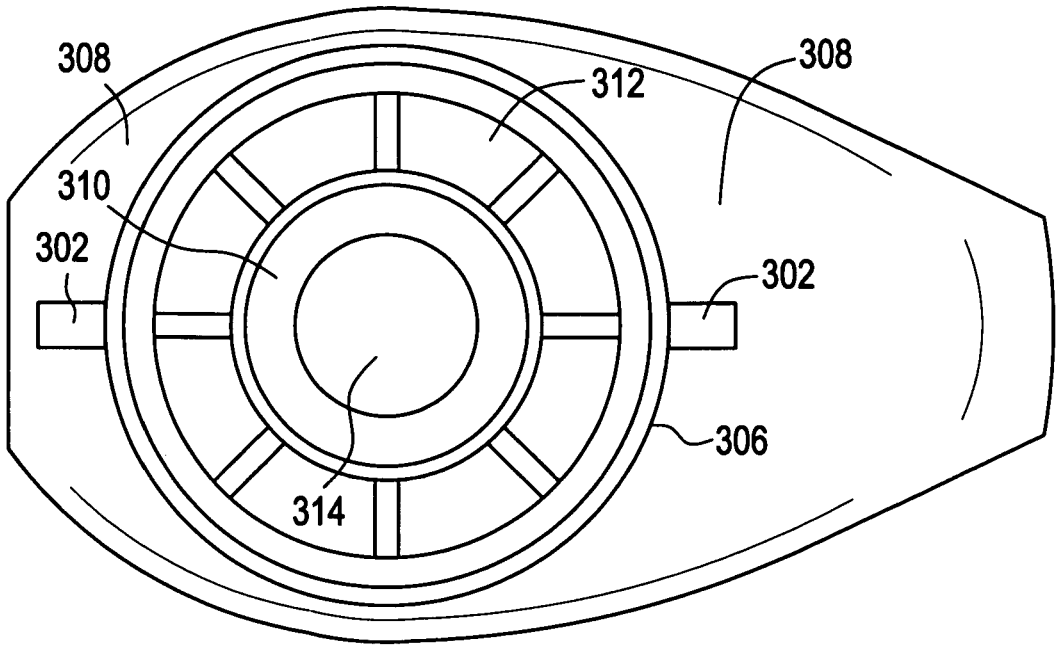
FIG. 3C is a bottom view showing the bottom of the field housing of FIG. 1, according to at least one embodiment of the present invention.

FIG. 3C is a bottom view showing field housing 102 in more detail, according to at least one embodiment of the present invention.

Figure 3D:
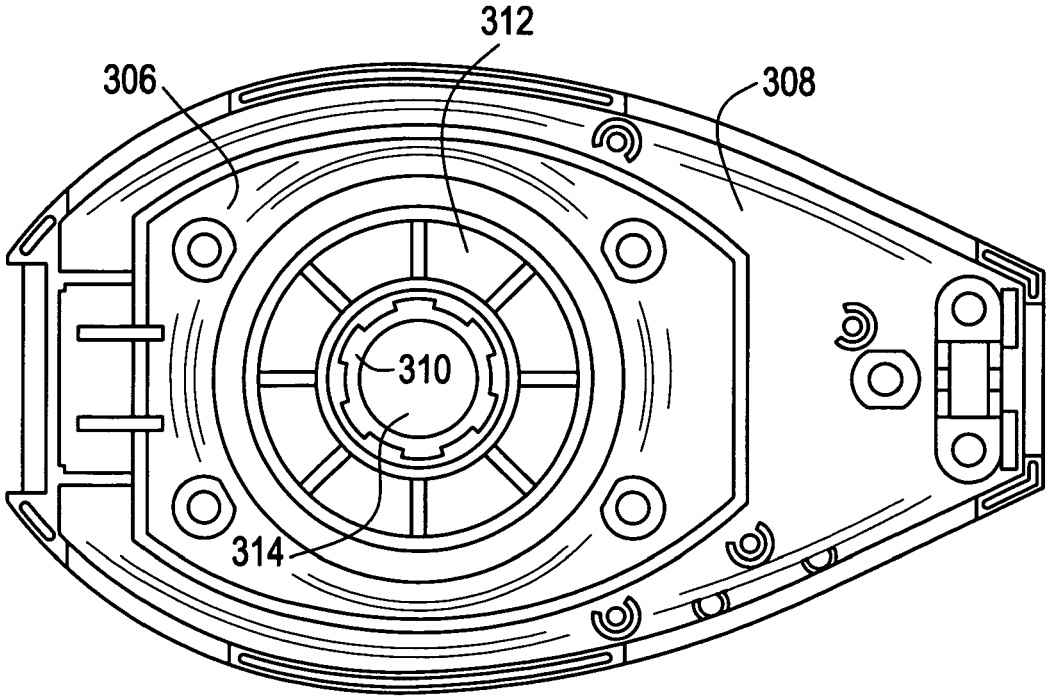
FIG. 3D is a top view looking (in more detail) into the field housing of FIG. 1, according to at least one embodiment of the present invention.

FIG. 3D is a top view looking (in more detail) into the interior of field housing 102, according to at least one embodiment of the present invention.

In FIGS. 3A–3D, field housing 102: has a generally tubular shape that can be described as a jam pot type of housing; has a central axis along which would be aligned an armature shaft (not shown) of the motor (again, not shown) that would be disposed therein; is injection molded of a suitable polymer; and is of monolithic construction. Alternatively, field housing 102 could be a two-part clam shell type of housing. Groove 118 can be described as an interface structure by which shrouds 104 and 108 are connectible to field housing 102. Field housing 102 can be described as being divided into a lower portion 306 and an upper portion 308 by groove 118.

Recalling FIGS. 1, 2A and 2B, it should be realized that lower portion 306 of field housing 102 is received within shrouds 104 and 108, respectively. Lower portion 306 can include bosses 302 which align with corresponding bosses on shrouds 104 and 108, respectively. Bosses 302 (and their counterparts on shrouds 104 and 108, respectively) receive fasteners (not shown) that compress together shroud-halves 106A & 106B and 110A & 110B, respectively, against and around lower portion 306 of field housing 102.

At an end of lower portion 306 distal to groove 118, a support structure 310 is formed to accommodate a central shaft bearing (not shown) is formed. A hole 314 is formed in support-structure 310 through which would pass the armature shaft (not shown) of the motor (again, not shown) that would be disposed in field housing 102. Also, ports 312 are formed at the distal end of lower portion 306. Ports 312 permit the passage of air for cooling the motor that would be disposed in field housing 102.

An end of upper portion 308 of field housing that is distal to groove 118 can be described as flaring outward. The distal end, and top cap 112, together define a shape compatible for grasping by the hand of a user. The distal end can have ports 304 formed therein, which can permit the passage of air for cooling the motor (again, not shown) that would be disposed in field housing 102.

Figure 4A:
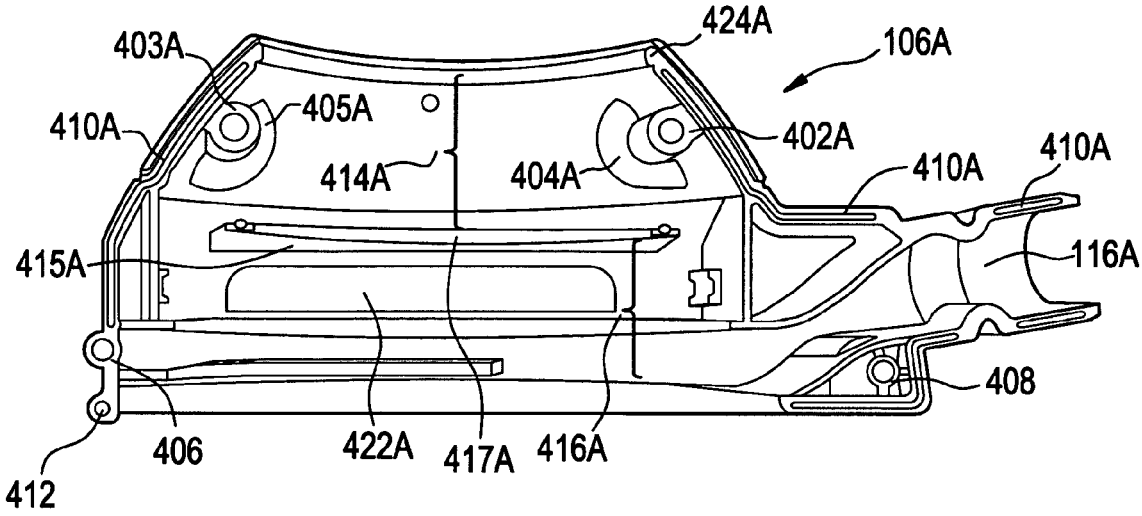
FIG. 4A is a side view of an ROS shroud-half for the modular sander-casing architecture, according to at least one embodiment of the present invention.

FIG. 4A is a side view of shroud-half 106A of ROS shroud 104, according to at least one embodiment of the present invention.

Figure 4B:
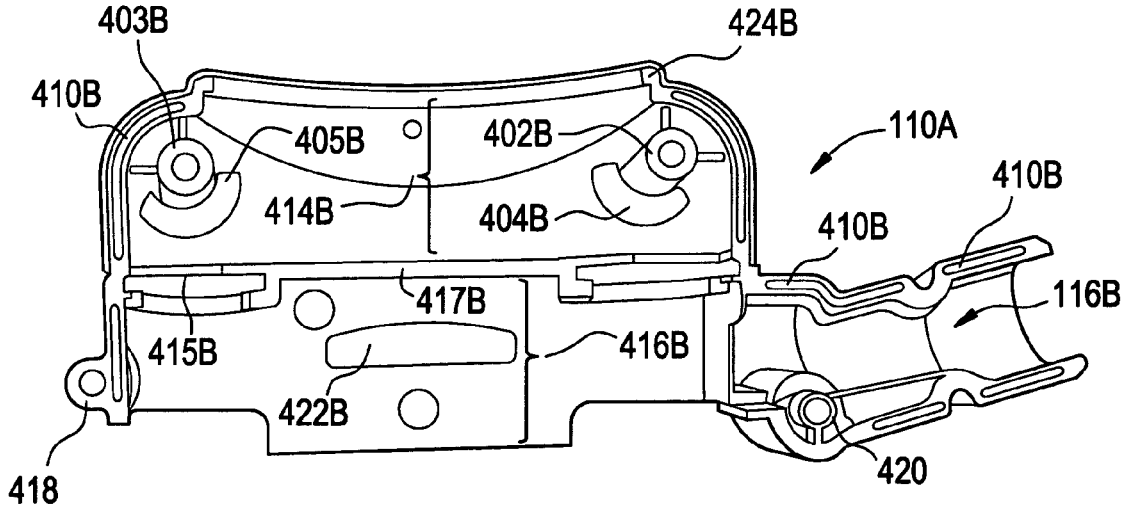
FIG. 4B is a side view of a QSS shroud-half for the modular sander-casing architecture, according to at least one embodiment of the present invention.

FIG. 4B is a side view of shroud-half 110A of QSS shroud 108, according to at least one embodiment of the present invention.

The perspectives of FIGS. 4A and 4B look at the interior surfaces of shroud-halves 106A and 110A, respectively. Except as noted, shroud-halves 106B and 110B are substantially similar to shroud-halves 106A and 110A.

In FIG. 4A, the interior side of shroud-half 106A can be described as being divided into a motor cavity 414A and a fan cavity 416A by a fin 415A projecting from the exterior wall of RSS shroud-half 106A. A surface 417A of fin 415A is arcuate so as to compatibly fit against the circumference of lower portion 306 of field housing 102. When ROS-shroud 104 receives field housing 102, ports 312 and support-structure 310 are disposed below fin 415A, namely in fan-cavity 416A. Bosses 402A and 403A align with bosses 302 on field housing 102. Recess portions 404A and 405A of the sidewall of shroud-half 106A are formed adjacent to bosses 402A and 403A, respectively, to provide an enlarged open area for the fasteners (again, not shown) that would pass through bosses 402A and 402B. Additional bosses 406 and 408 can be provided.

In fan-cavity 416A, an air inlet 422A is formed in the sidewall of shroud-half 106A. A centrifugal fan (not shown) would be disposed in fan-cavity 416A and driven, e.g., by the armature shaft (again, not shown) of the motor (again, not shown).

Previously, it was mentioned that groove 118 is an interface structure by which shroud 104 is connectible to field housing 102. Lip 424A is the corresponding interface structure on shroud-half 106A. Lip 424A is arcuate so as to compatibly locate in groove 118, and as such serve as the tongue in a tongue-and-groove arrangement therewith.

The connection of shroud-half 106A to shroud-half 106B can be facilitated by another tongue-and-groove arrangement running along the abutting surfaces of the opposing sidewalls. More particularly, grooves 410A are formed in the abutting surfaces of the sidewall of shroud-half 106A. Corresponding tongues (not shown) are formed in the corresponding abutting sidewall surfaces of shroud-half 106B. In addition, the connection of shroud-half 106A to shroud-half 106B can be further facilitated by a mortise-and-tenon type of assembly, where a mortise 412 can be formed in an abutting surface of the sidewall of shroud-half 106A, while a tenon (not shown) is formed in the corresponding abutting sidewall surface of shroud-half 106B.

In FIG. 4B, the interior side of QSS shroud-half 110A can be described as being divided into a motor cavity 414B and a fan cavity 416B by a fin 415B projecting from the exterior wall of shroud-half 110A. A surface 417B of fin 415B is arcuate so as to compatibly fit against the circumference of lower portion 306 of field housing 102. When QSS-shroud 108 receives field housing 102, ports 312 and support-structure 310 are disposed below fin 415B, namely in fan-cavity 416B. Bosses 402B and 403B align with bosses 302 on field housing 102. Recess portions 404B and 405B of the sidewall of shroud-half 110A are formed adjacent to bosses 402B and 403B, respectively, to provide an enlarged open are for the fasteners (again, not shown) that pass through bosses 402B and 402B. Additional bosses 418 and 420 can be provided.

In fan-cavity 416B, an air inlet 422B is formed in the sidewall of shroud-half 110A. A centrifugal fan (not shown) would be disposed in fan-cavity 416B and driven, e.g., by the armature shaft (again, not shown) of the motor (again, not shown).

Previously, it was mentioned that groove 118 is an interface structure by which shroud 108 is connectible to field housing 102. Lip 424B is the corresponding interface structure on shroud-half 106B. Lip 424B is arcuate so as to compatibly locate in groove 118, and as such serve as the tongue in a tongue-and-groove arrangement therewith.

The connection of shroud-half 110A to shroud-half 110B can be facilitated by another tongue-and-groove arrangement running along the abutting surfaces of the opposing sidewalls. More particularly, grooves 410B are formed in the abutting surfaces of the sidewall of shroud-half 110A. Corresponding tongues (not shown) are formed in the corresponding abutting sidewall surfaces of shroud-half 110B.

Groove 118 and lip 424A/424B are depicted as continuous. Alternatively, lip 424A/424B can be discontinuous so as to serve as a plurality of tongues insertable into groove 118. Further in the alternative, groove 118 can be correspondingly discontinuous in the circumstance where lip 424A/424B is discontinuous. The latter alternative can distribute the tongue sections and corresponding groove sections so as to encourage, if not substantially ensure, achievement of a desired orientation of shroud 104 relative to field housing 102.

Figure 5A:
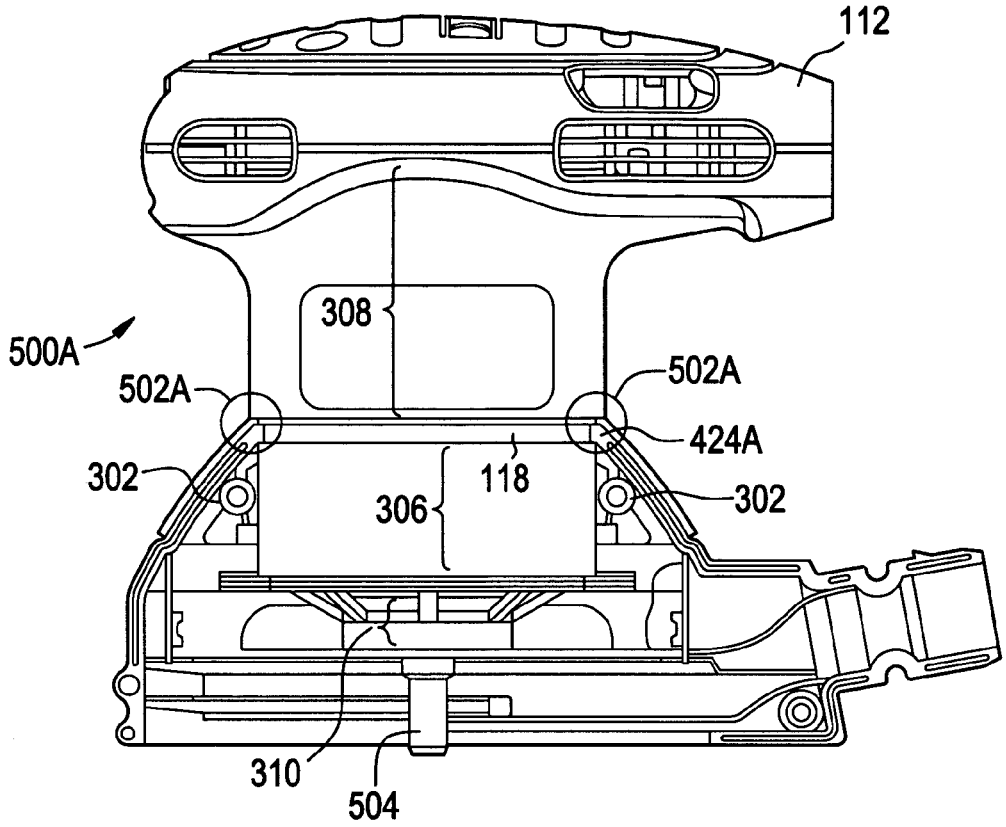
FIG. 5A is a side view of the field housing of FIG. 3A to which is fitted the ROS shroud-half of FIG. 4A, according to at least one embodiment of the present invention.

FIG. 5A is a side view of an arrangement 500A of field housing 102 (as in FIG. 3A) to which is fitted ROS shroud-half 106A (as in FIG. 4A), according to at least one embodiment of the present invention.

Figure 5B:
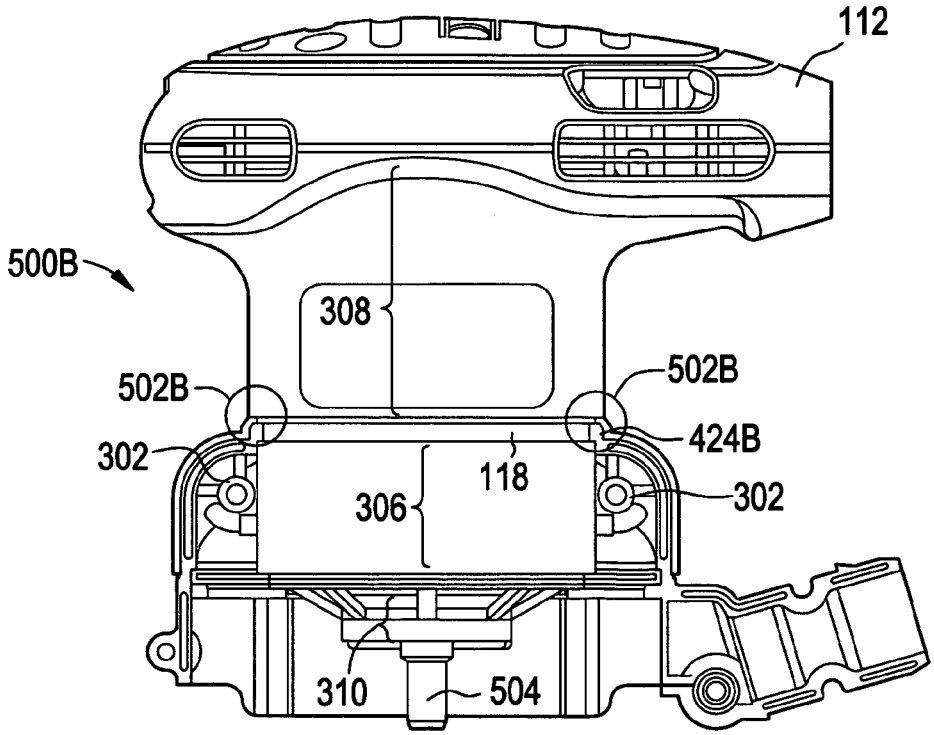
FIG. 5B is a side view of the field housing of FIG. 3A to which is fitted the QSS shroud-half of FIG. 4B, according to at least one embodiment of the present invention.

FIG. 5B is a side view of an arrangement 500B of field housing 102 (as in FIG. 3A) to which is fitted QSS shroud-half 110A (as in FIG. 4B), according to at least one embodiment of the present invention.

In FIG. 5A, the previously-mentioned tongue-and-groove arrangement of groove 118 and lip 424A is called out via circled-areas having reference number 502A. To enhance the illustration, FIG. 5A depicts an armature shaft 504 extending from support-structure 310.

In FIG. 5B, the previously-mentioned tongue-and-groove arrangement of groove 118 and lip 424B is called out via circled-areas having reference number 502B. To enhance the illustration, FIG. 5B depicts an armature shaft 504 extending from support-structure 310.

Figure 6A:
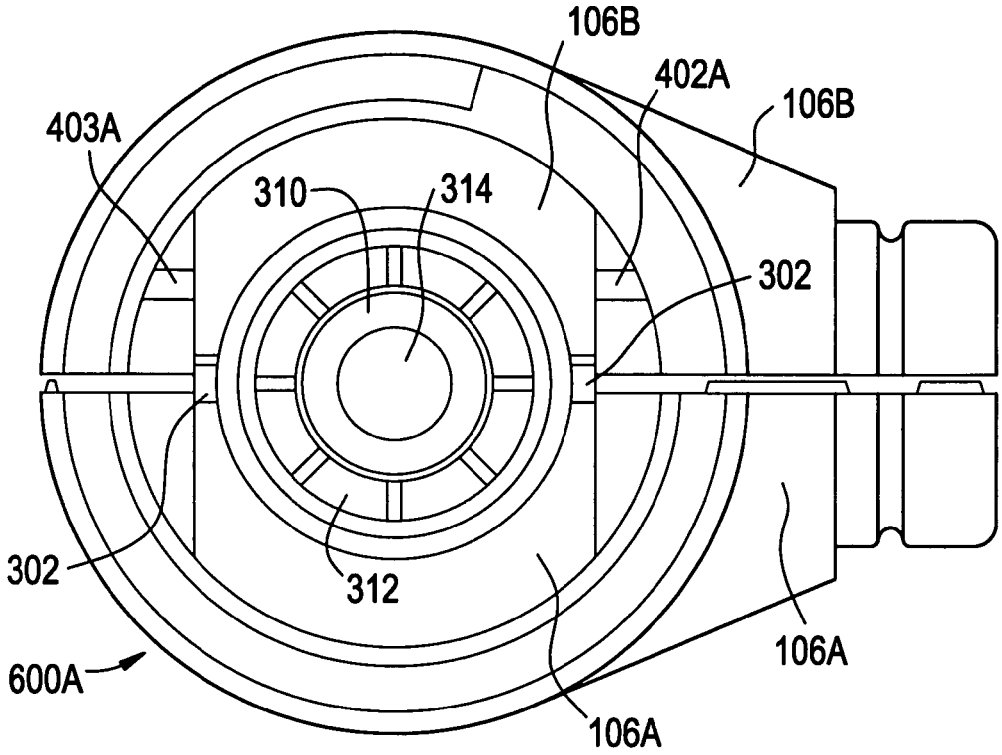
FIG. 6A is a bottom view of an arrangement of the field housing of FIG. 3A to which is loosely fitted the ROS shroud-half of FIG. 4A and its corresponding ROS shroud-half, according to at least one embodiment of the present invention.

FIG. 6A is a bottom view of an arrangement 600A of field housing 102 to which is loosely fitted ROS shroud-half 106A (as in FIG. 4A) and its corresponding ROS shroud-half 106B, according to at least one embodiment of the present invention.

Figure 6B:
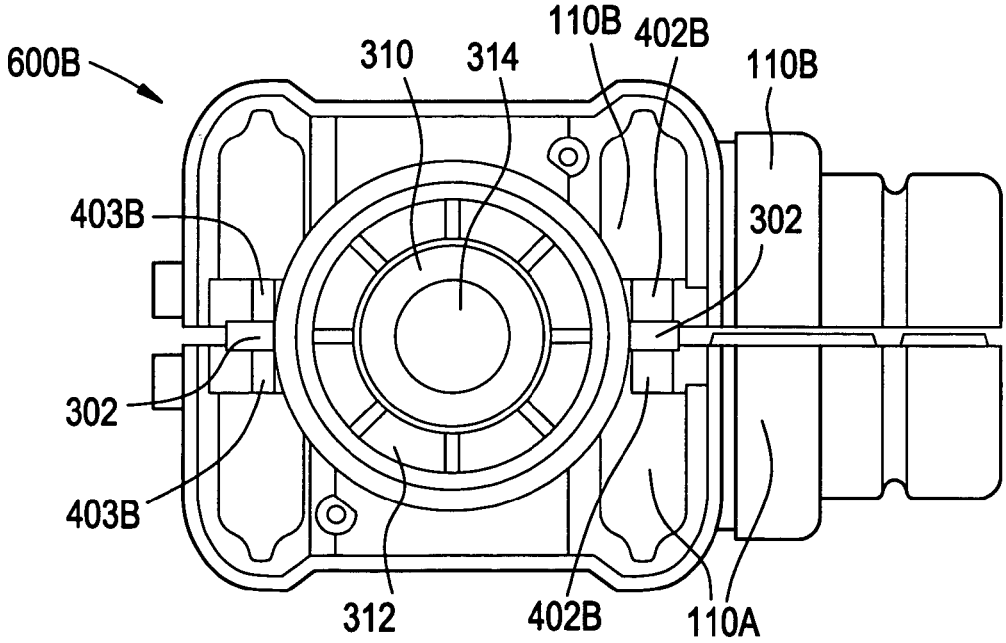
FIG. 6B is a bottom view of an arrangement of the field housing of FIG. 3A to which is loosely fitted the QSS shroud-half 110B of FIG. 4A and its corresponding QSS shroud-half, according to at least one embodiment of the present invention.

FIG. 6B is a bottom view of an arrangement 600B of field housing 102 to which is loosely fitted QSS shroud-half 110A (as in FIG. 4A) and its corresponding QSS shroud-half 110B, according to at least one embodiment of the present invention.

It is noted that phantom lines are drawn between the left-most and right-most edges, respectively, of support-structure 310 of field-housing 102 in FIGS. 6A–6B to better call out similarities between FIGS. 6A–6B.

Figure 7:
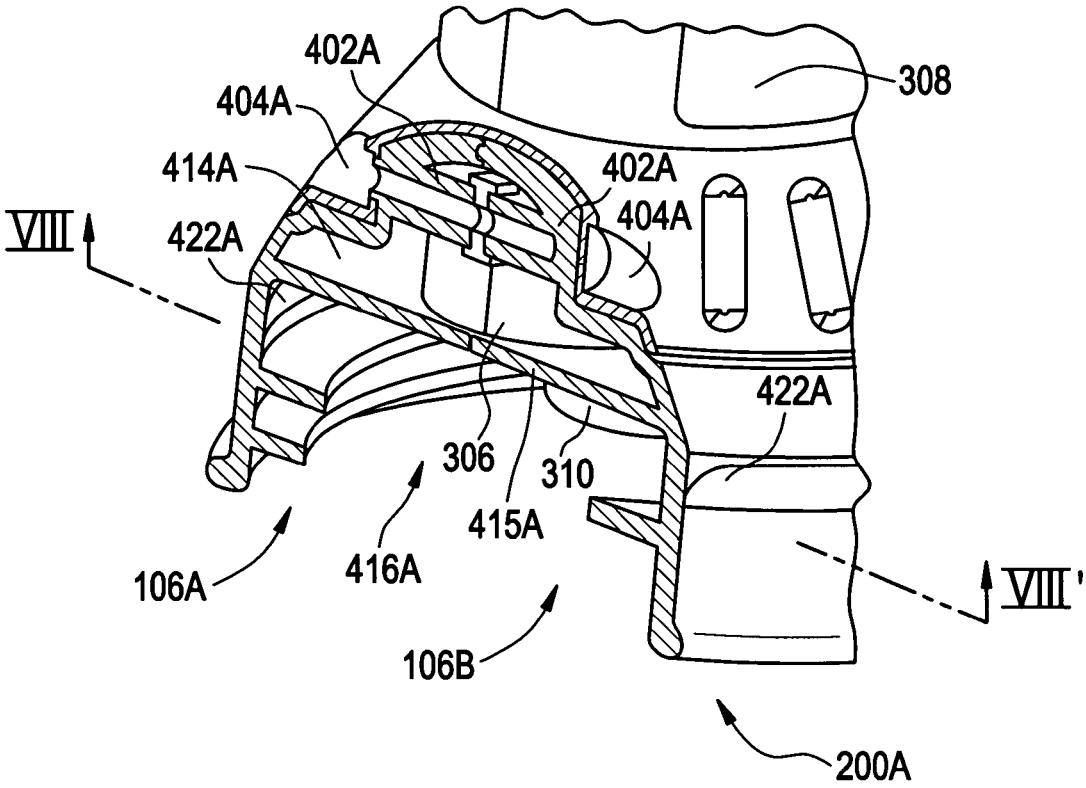
FIG. 7 is a three-quarter perspective cutaway view of the ROS casing of FIG. 2A, according to at least one embodiment of the present invention.

FIG. 7 is a three-quarter perspective cutaway view of ROS casing 200A of FIG. 2A, according to at least one embodiment of the present invention.

Figure 8:
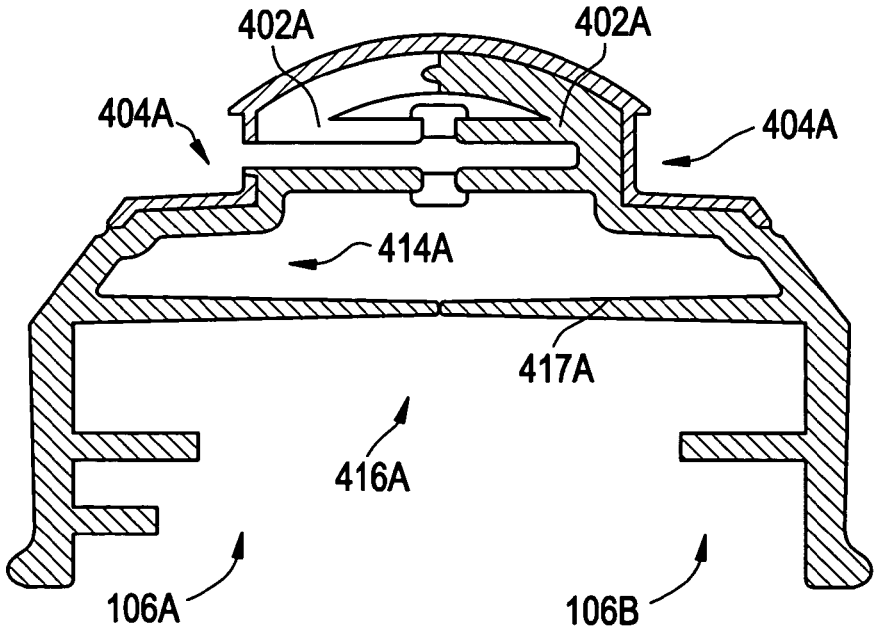
FIG. 8 is a broken out section of the ROS casing depicted in FIG. 7, taken along the break line VIII–VIII'.

FIG. 8 is a broken out section of the ROS casing depicted in FIG. 7, taken along the break line VIII–VIII' of FIG. 7. Because FIG. 8 is a broken-out section, boss 402A of RSS shroud-half 106B appears to have a blind hole formed therein, whereas in other figures boss 402A has a through hole. It should be recognized that this is a drafting anomaly in FIG. 7 arising from the angle of break line VIII–VIII' with respect to the central axis of field housing 102.

Figure 9:
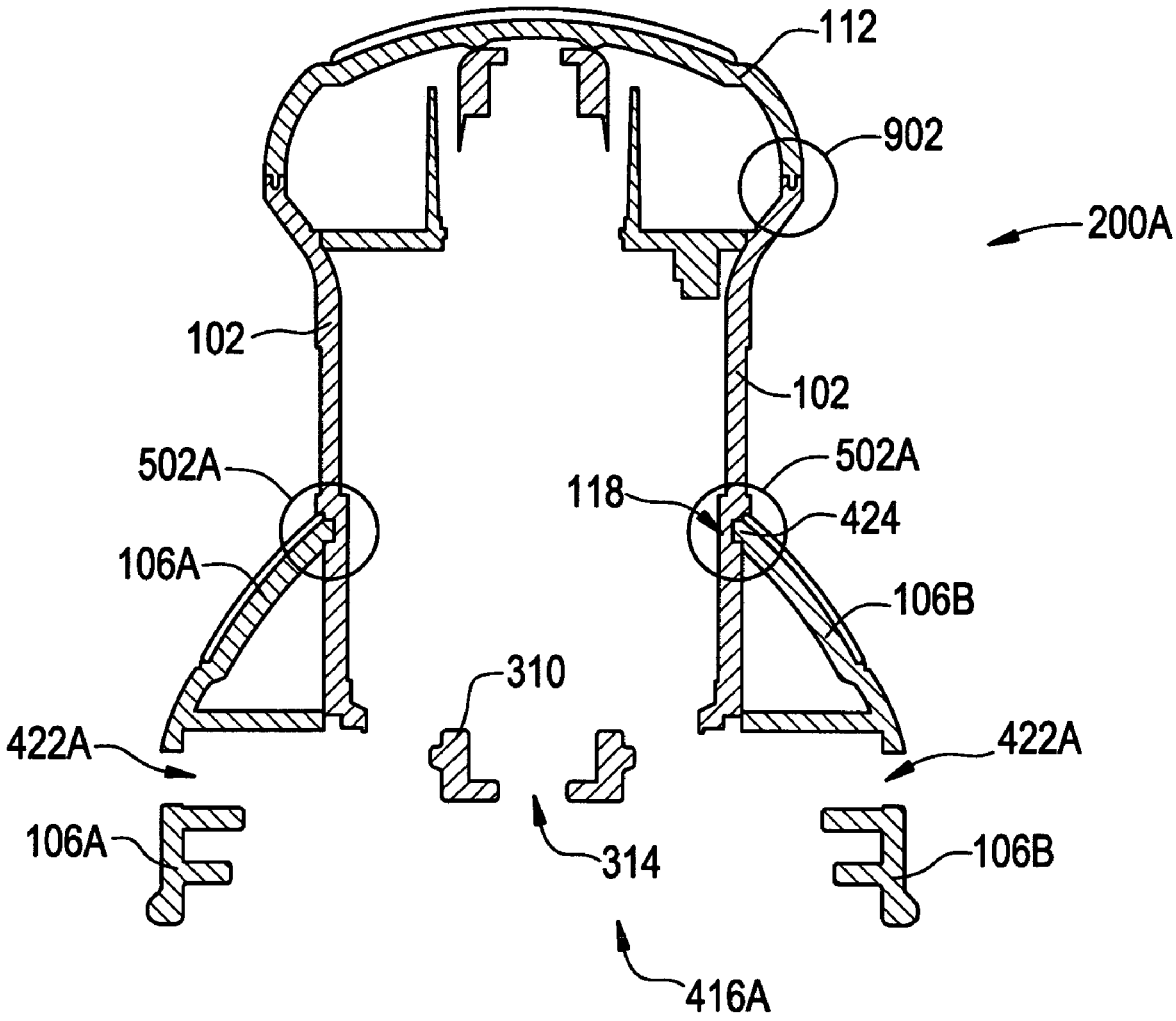
FIG. 9 is a broken out section of the ROS casing depicted in FIG. 7, taken along the break line IX–IX'.

FIG. 9 is a broken out section of ROS casing 200A depicted in FIG. 2A, taken along the break line IX–IX'.

In FIG. 9, top cap 112 is joined to field housing 102 by a tongue and groove arrangement 902.

Figure 10A:
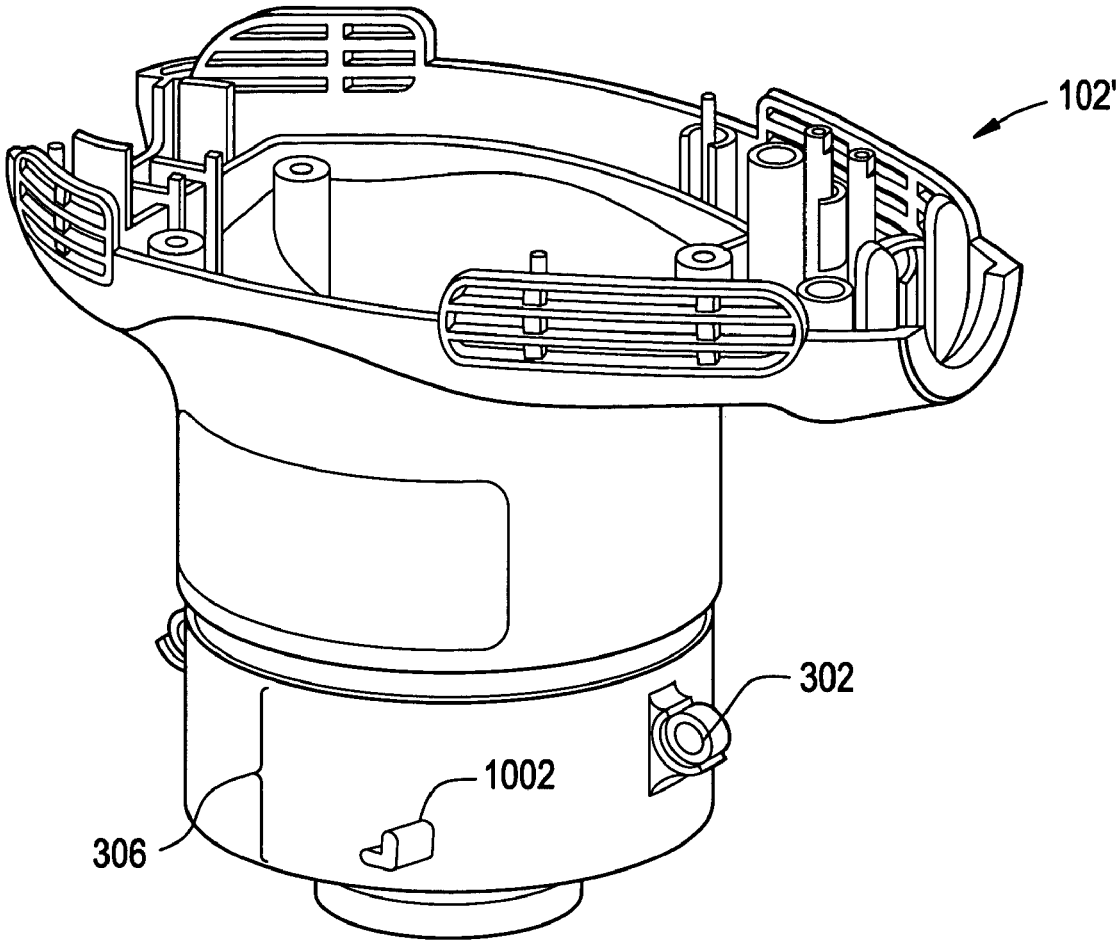
FIG. 10A is a three-quarter perspective view of another field housing for the modular sander-casing architecture, according to at least one embodiment of the present invention.

FIG. 10A is a three-quarter perspective view of another field housing 102' for the modular sander-casing architecture 100, according to at least one embodiment of the present invention.

Figure 10B:
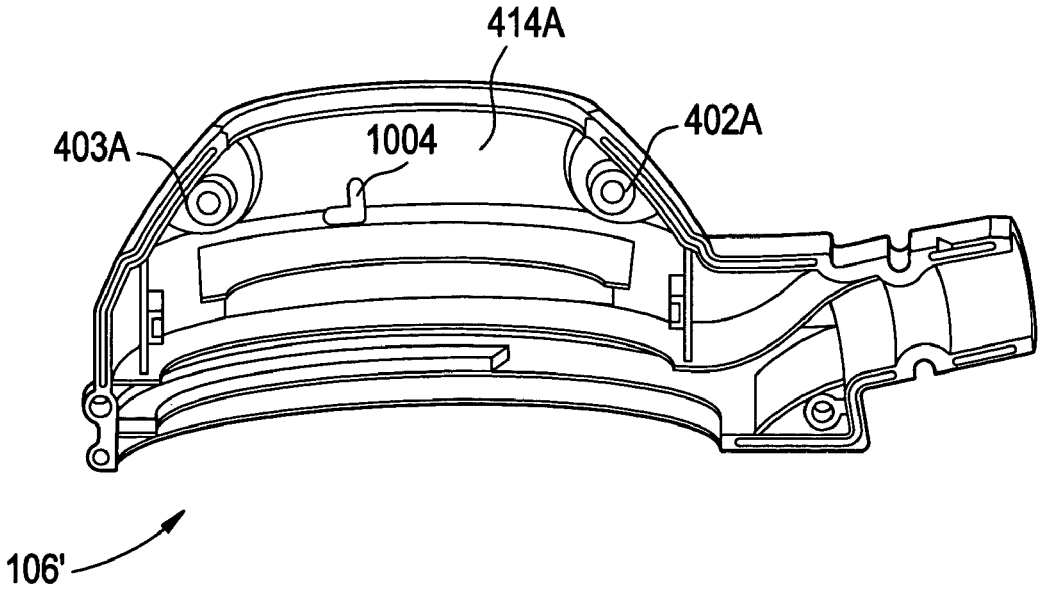
FIG. 10B is a side view of another ROS shroud-half for the modular sander-casing architecture, according to at least one embodiment of the present invention.

FIG. 10B is a side view of another ROS shroud-half 106A' for the modular sander-casing architecture 100, according to at least one embodiment of the present invention.

In FIG. 10A, field housing 102' is substantially similar to field housing 102 of FIG. 3A. In contrast, however, field housing 102' further includes a protrusion 1002, extending normally from the exterior circumferential surface of lower portion 306. Protrusion 1002 can be L-shaped in cross-section. A variety of other shapes could be used.

In FIG. 10B, ROS shroud-half 106A' is substantially similar to ROS shroud-half 106A of FIG. 4A. In contrast, however, ROS shroud-half 106A' further includes a protrusion 1004, extending normally from the interior sidewall of ROS shroud-half 106A'. Protrusion 1004 can extend in a direction substantially parallel to a long axis of boss 402A and/or boss 403A. Protrusion 1004 can be L-shaped in cross-section. A variety of other shapes could be used. It is noted that a comparable version of QSS shroud-half 106B could be prepared, etc.

The arrangement of bosses 402A and 403A on ROS shroud-halves 106A' and 106B' and counterpart bosses 302 on field housing 102 encourages, if not substantially ensures, achievement of one among two related orientations, where one of the orientations is more desired and one is reversed with respect to the more desired orientation and so is less desired. Protrusions 1002 and 1004 are located so as to encourage, if not substantially ensure, achievement of the more desired of the two orientations. When the more desired orientation is accomplished, ROS shroud-half 106' is fitted to field housing 102' in such a way that protrusions 1002 and 1004 do not collide with each other. But when the less desired orientation is inadvertently carried out, an attempt to fit ROS shroud-half 106' against field housing 102' results in protrusions 1002 and 1004 colliding with each other, which at the least discourages completion of the less desired orientation.

Figure 10C:
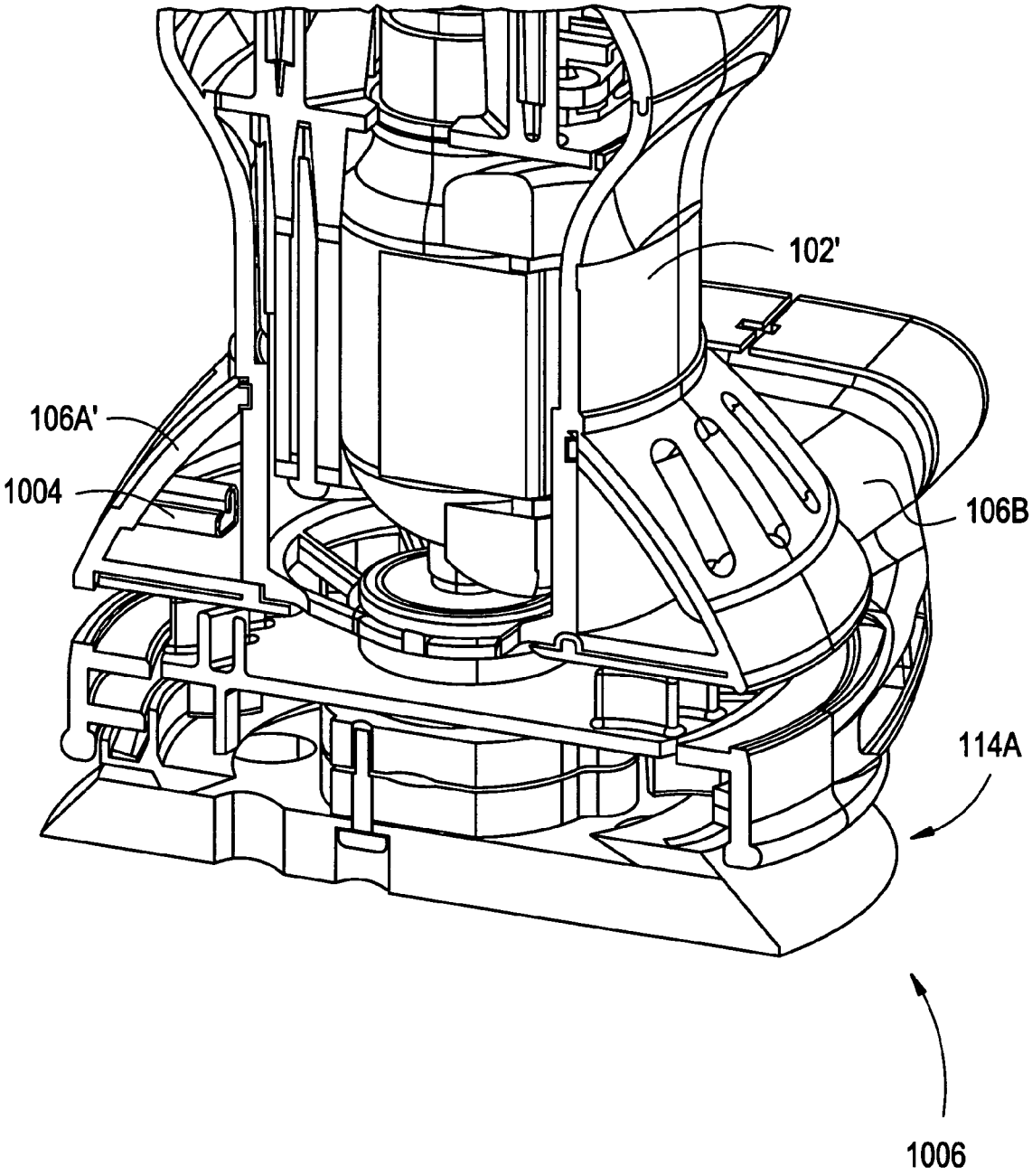
FIG. 10C is a three-quarter perspective cutaway view along a first break line of the field housing of FIG. 10A to which is fitted the ROS shroud-half of FIG. 10B, according to at least one embodiment of the present invention.

FIG. 10C is a three-quarter perspective cutaway view along a first break line of field housing 102' to which is fitted ROS shroud-halves 106A' and 106B, according to at least one embodiment of the present invention. Because the desired orientation has been achieved, protrusion 1004 has not collided with protrusion 1002 (not shown in FIG. 10C).

Figure 10D:
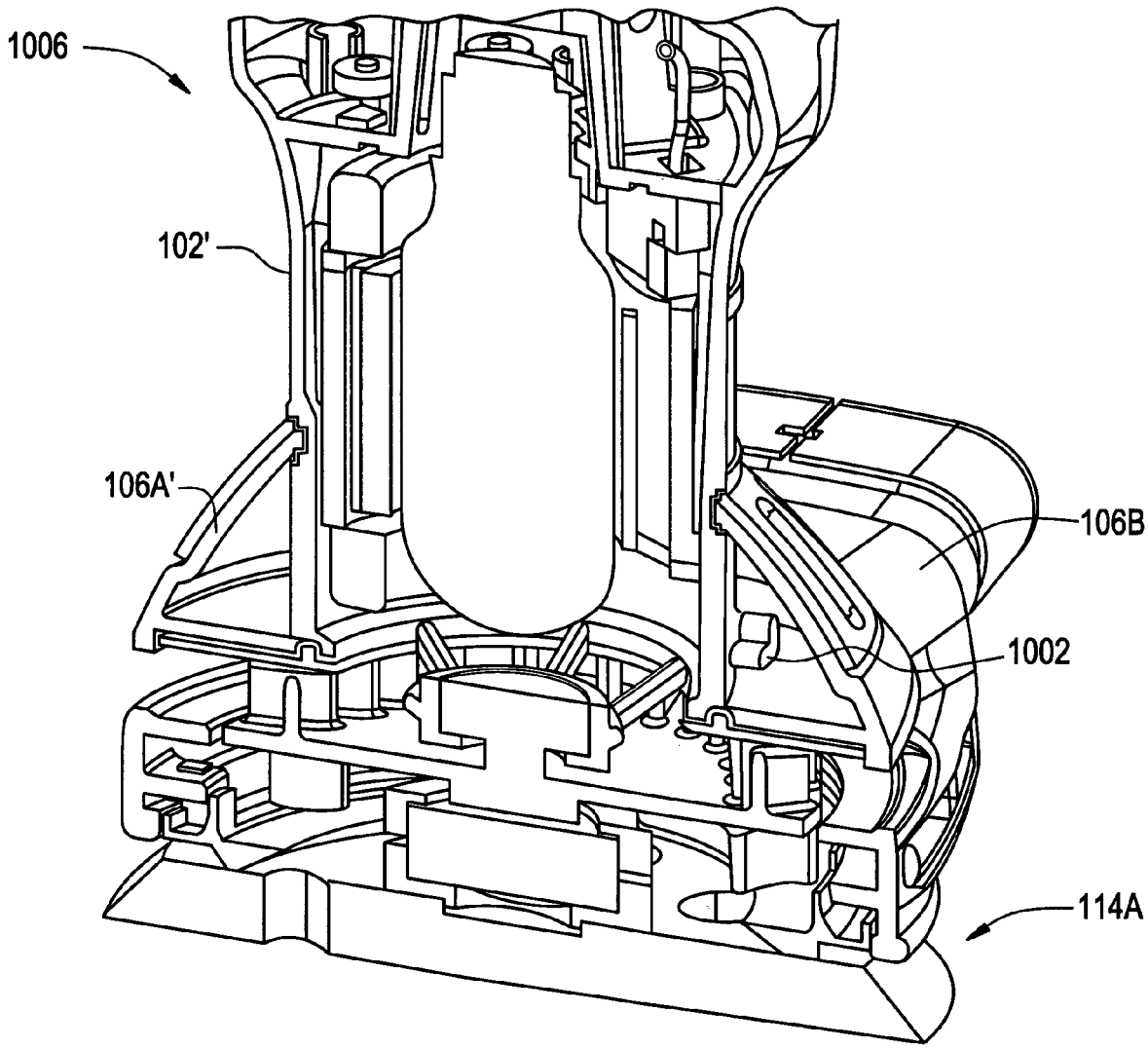
FIG. 10D is a three-quarter perspective cutaway view along a second break line of the field housing of FIG. 10A to which is fitted the ROS shroud-half of FIG. 10B, according to at least one embodiment of the present invention.

FIG. 10D is a three-quarter perspective cutaway view along a second break line of field housing 102' to which is fitted ROS shroud-halves 106A' and 106B, according to at least one embodiment of the present invention. Because the desired orientation has been achieved, protrusion 1002 has not collided with protrusion 1004 (not shown in FIG. 10C).

Figure 11:
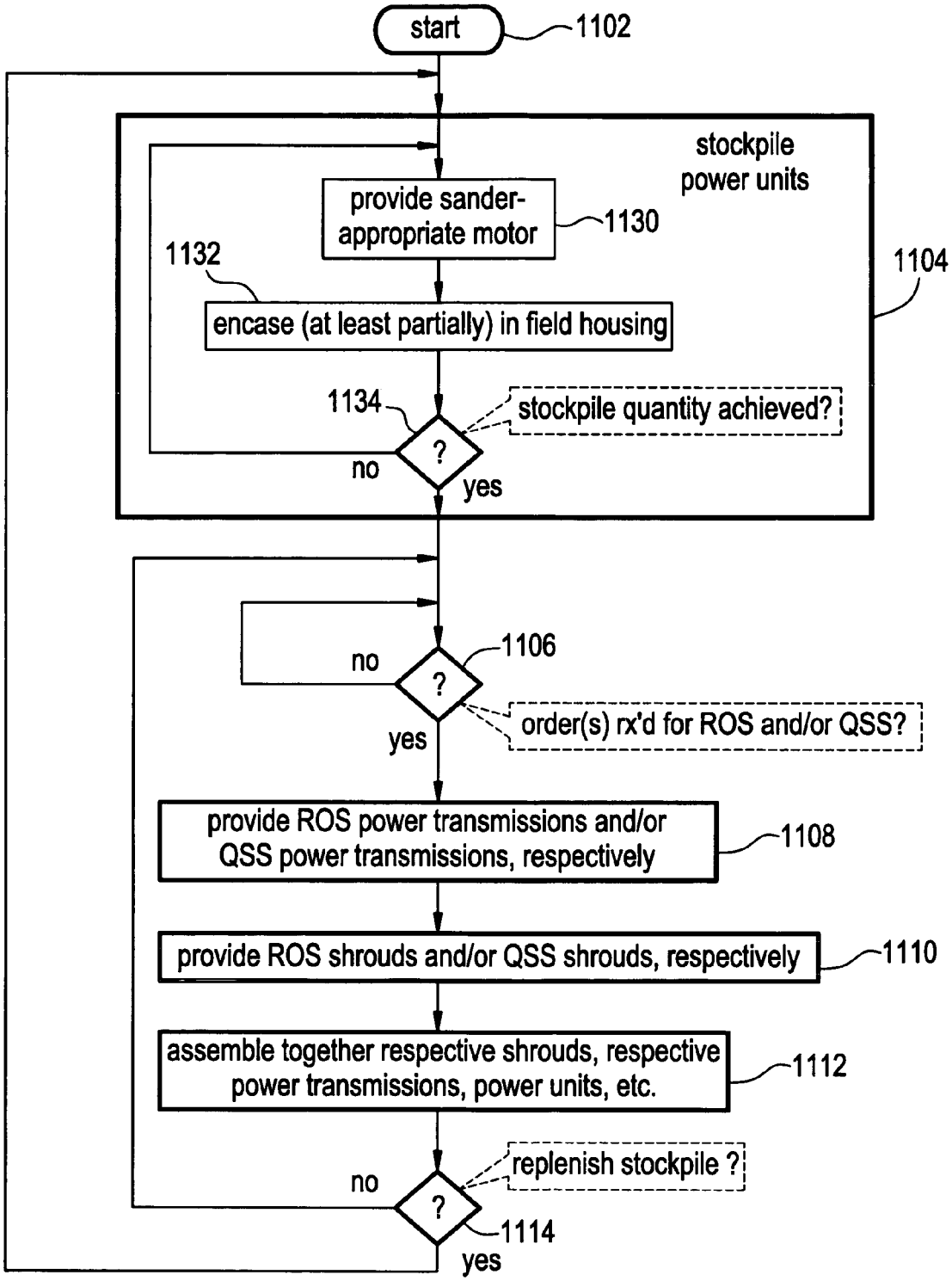
FIG. 11 is a flow diagram of a modular method of manufacturing sanders, according to at least one embodiment of the present invention.

FIG. 11 is a flow diagram of a modular method of manufacturing sanders, e.g., random orbital sanders (again, ROSs) and quarter-sheet sanders (again, QSSs), according to at least one embodiment of the present invention.

Flow in FIG. 11 begins at block 1102 and proceeds to block 1104, where at least partially assembled sander-appropriate power units, e.g., using field housings 102 or 102', are stockpiled without also stockpiling a corresponding number of sander-appropriate power-transmissions with which the plurality of at-least-partially-assembled power units can be mated. Assuming that the same motor is used for both the ROS sander and the QSS sander, and because field housings 102/102' can be used with either ROS shroud 104 or QSS shroud 108, then at least partially pre-assembled power units can be used with either ROS power-transmissions & ROS shrouds 104 or QSS power transmissions & QSS shrouds 108. In other words, a stockpile for manufacturing ROSs and QSSs according to the method of FIG. 11 can include a plurality X of field housings 102 or 102', where X is a positive integer, and a number Y of ROS shrouds, where $0 \leqq Y \leqq X$ 104 and/or a number Z of QSS shrouds 108 where $0 \leqq Z \leqq X$.

From block 1104, flow proceeds to decision block 1106, where it is determined whether one or more orders have been received for the ROS and/or the QSS. If not, then such an order(s) can be awaited by looping through decision block 1106. But if so (namely, one or more orders have been received), then flow proceeds to block 1108.

At block 1108, at least partially assembled ROS power-transmissions and/or QSS power transmissions are provided according to the details of the one or more orders, respectively. Next, at block 1110, ROS shrouds 104 and QSS shrouds 108 are provided according to the details of the one or more orders, respectively. And then at block 1112, the respective shrouds (RSS and/or QSS), the respective power transmissions (RSS and/or QSS), the at least partially pre-assembled power units, etc. are assembled together. In view of the varying circumstances under which the assembling called for in block 1112 can arise, it is contemplated that various sequences of assembly can be used. As but one example, two half shrouds can be loosely attached to an at least partially assembled power unit, then the respect power transmission can be connected to the at least partially assembled power unit, etc.

From block 1112, flow proceeds to decision block 1114, where it is determined whether the stockpile of power units has been reduced sufficiently to warrant replenishment. If not, then flow loops back to decision block 1106 to await another order. But if so, then flow loops back to stockpiling block 1104 to replenish the stockpile.

Of course, although several variances and example embodiments of the present invention are discussed herein, it is readily understood by those of ordinary skill in the art that various additional modifications may also be made to the present invention. Accordingly, the example embodiments discussed herein are not limiting of the present invention.

What is claimed:

1. A sander-casing comprising:

a field housing to contain at least a motor, the field housing having an interface connectable to each of the following, a multi-part random orbital sander (ROS) shroud, an ROS-type power transmission being containable therein, and a multi-part quarter sheet sander (QSS) shroud, a QSS-type power transmission being containable therein;

one or more of the field housing and the interface being respectively cooperatively configured to permit connection with a given shroud be it the ROS shroud or the QSS shroud, the permitted connection having only one orientation of each part of the given shroud relative to the field housing, respectively.

2. The sander-casing of claim 1, wherein the field housing is a jam pot type of housing.

3. The sander-casing of claim 2, wherein the jam pot housing is of a monolithic construction.

4. The sander-casing of claim 1, further comprising:

one of the ROS shroud and the QSS shroud;

each of the ROS shroud and the QSS shroud including an interface compatible with the interface of the field housing.

5. The sander-casing of claim 1, wherein each of the ROS shroud and the QSS shroud is a two-part claim-shell-type of arrangement, the two parts of the given shroud being mirror-symmetric with respect to each other.

6. The sander-casing of claim 1, wherein the field housing is tubular and has a central axis.

7. The sander-casing of claim 6, wherein:

the field housing has a circumferential groove as in a tongue-and-groove arrangement; and each of the ROS shroud and the QSS shroud has a circumferential tongue compatible with the groove of the field housing.

8. The sander-casing of claim 7, wherein at least one of the tongue and the groove is at least discontinuous.

9. The sander-casing of claim 6, wherein:

each of the ROS shroud and the QSS shroud receives a lower portion of the tubular field housing.

10. The sander-casing of claim 9, wherein, regardless of whether the field housing is received by the ROS shroud or the QSS shroud, the same portion of the field housing remains outside the respective shroud.

11. A sander-casing comprising:

a field housing to contain at least a motor, the field housing having an interface connectable to each of the following, a random orbital sander (ROS) shroud, an ROS-type power transmission being containable therein, and a quarter sheet sander (QSS) shroud, a QSS-type power transmission being containable therein;

one or more of the field housing and the interface respectively being configured to cooperate with each of the ROS shroud and the QSS shroud so as to promote desired orientations relative to the field housing, respectively;

the field housing having one or more bosses compatible with a corresponding one or more bosses on each of an ROS shroud and a QSS shroud, respectively; and each of the ROS shroud or the QSS shroud having one or more bosses compatible with the one-or-more bosses on the field housing, respectively.

12. The sander-casing of claim 11, wherein the one-or-more bosses on the ROS shroud is compatible with the same one-or-more bosses on the field housing with which the one-or-more bosses on the QSS shroud are compatible.

13. The sander-casing of claim 11, wherein:

there are two bosses on the field housing; and there are two bosses on each of the ROS shroud and the QSS shroud compatible therewith, respectively.

14. A sander-casing comprising:

a field housing to contain at least a motor, the field housing having an interface connectable to each of the following, a random orbital sander (ROS) shroud, an ROS-type power transmission being containable therein, and a quarter sheet sander (QSS) shroud, a QSS-type power transmission being containable therein;

one or more of the field housing and the interface respectively being configured to cooperate with each of the ROS shroud and the QSS shroud so as to promote desired orientations relative to the field housing, respectively;

the field housing having a first protrusion on an inner surface; and each of the ROS shroud and the QSS shroud having a second protrusion on an inner surface;

the first and second protrusions being located so as not to collide with each other when either one of the ROS shroud and the QSS shroud is connected to the field housing according to a desired orientation; and collide with each other when either one of the ROS shroud and the QSS shroud is connected to the field housing according to an undesired orientation.

15. A sander-casing apparatus comprising:

field housing means for containing at least a motor;

at least one of multi-part random orbital sander (ROS) shroud means for containing an ROS-type power transmission, and multi-part quarter sheet sander (QSS) shroud means for containing a QSS-type power transmission; and interface means by which the field housing is made connectable to the ROS shroud and the QSS shroud;

one or more of the field housing means and the interface means being respectively cooperatively configured to permit connection with a given shroud means be it the ROS shroud means or the QSS shroud means, the permitted connection having only one orientation of each part of the given shroud means relative to the field housing means, respectively.

16. A sander-casing apparatus comprising:

field housing means for containing at least a motor;

at least one of random orbital sander (ROS) shroud means for containing an ROS-type power transmission, and quarter sheet sander (QSS) shroud means for containing a QSS-type power transmission; and interface means by which the field housing is made connectable to the ROS shroud and the QSS shroud;

the ROS shroud means and the QSS shroud means being configured for cooperation with one or more of the field housing means and the interface means so as to promote desired orientations relative to the field housing means, respectively;

one or more of the field housing means and the interface means respectively being configured to cooperate with each of the ROS shroud means and the QSS shroud means so as to promote desired orientations relative to the field housing means, respectively;

first protrusion means on the field housing means; and second protrusion means on each of the ROS shroud means and the QSS shroud means, each second protrusion means being for discouraging an undesired orientation of the shroud means relative to the field housing means by colliding with each other according to an desired orientation, and not colliding with each other according to the desired orientation.

17. A method of assembling a sander-casing, the method comprising:

providing a field housing to contain at least a motor, the field housing having an interface connectable to each of the following, a multi-part random orbital sander (ROS) shroud, at least an ROS-type power transmission being containable therein, and a multi-part quarter sheet sander (QSS) shroud, at least a QSS-type power transmission being containable therein; and cooperatively configuring one or more of the field housing and the interface, respectively, to permit connection with a given shroud be it the ROS shroud or the QSS shroud, the permitted connection having only one orientation of each part of the given shroud relative to the field housing, respectively;

providing one of the ROS shroud and the QSS shroud; and disposing the provided shroud around the field housing.

18. The method of claim 17, wherein:

the field housing has a circumferential groove as in a tongue-and-groove arrangement;

each of the ROS shroud and the QSS shroud has a circumferential tongue compatibly-shaped for the groove of the field housing; and the disposing of the provided shroud includes fitting the tongue into groove.

19. A method of assembling a sander-casing, the method comprising:

providing a field housing to contain at least a motor, the field housing having an interface connectable to each of the following, a random orbital sander (ROS) shroud, at least an ROS-type power transmission being containable therein, and a quarter sheet sander (QSS) shroud, at least a QSS-type power transmission being containable therein, the ROS shroud and the QSS shroud having configurations that cooperate with the configuration of one or more of the field housing and the interface to promote desired orientations relative to the field housing, respectively;

providing one of the ROS shroud and the QSS shroud; and disposing the provided shroud around the field housing;

the field housing having a first protrusion on an inner surface; and each of the ROS shroud and the QSS shroud having a second protrusion on an inner surface; and the disposing of the provided shroud includes orienting the provided shroud relative to the field housing so that the second protrusion does not collide with the first protrusion.

20. A method of manufacturing random orbit sanders and quarter-sheet sanders, the method comprising:

providing a sander-appropriate motor;

encasing, at least partially, the motor in a field housing to create an at least partially assembled power unit, each of the plurality of at-least-partially-assembled power units having the same interface, which is connectable to each of the following, a random orbital sander (ROS) shroud, an ROS-type power transmission being containable therein, and a quarter sheet sander (QSS) shroud, a QSS-type power transmission being containable therein; and stockpiling an amount X of the at-least partially-assembled power units, an amount Y of the ROS shrouds and an amount Z of the QSS shroud, where $X<(Y+Z)$, $X\geqq 3$, $Y\geqq 2$ and $Z\geqq 2$ and where $X>Y$ and $X>Z$, by iteratively repeating the steps of providing and encasing, while also stockpiling the amount Y of the ROS shrouds and the amount Z of the QSS shrouds with which instances of the amount X of at-least-partially-assembled power units can be mated, respectively.

21. The method of claim 20, wherein:

each of the ROS shroud and the QSS shroud has multiple parts; and a given shroud, be it the ROS shroud or the QSS shroud, has a configuration that cooperates with a configuration of one or more of the at-least-partially-assembled power unit and the interface to permit connection therewith, respectively, the permitted connection having only one orientation each part of the given shroud relative to the at-least-partially-assembled power unit, respectively.

22. A sander-casing stockpile comprising:

a plurality of field housings to respectively contain at least a motor, each of the field housings having an interface connectable to each of the following, a multi-part random orbital sander (ROS) shroud, an ROS-type power transmission being containable therein; and a multi-part quarter sheet sander (QSS) shroud, a QSS-type power transmission being containable therein; and at least one of the ROS shroud and the QSS shroud;

a given shroud, be it the ROS shroud or the QSS shroud, having a configuration that cooperates with the configuration of one or more of the field housing and the interface to permit connection therewith, respectively, the permitted connection having only one orientation of each part of the given shroud relative to the field housing, respectively.

23. The apparatus of claim 15, wherein each of the ROS shroud means and the QSS shroud means has a two-part claim-shell-type construction, the two parts of the given shroud means being mirror-symmetric with respect to each other.

24. The method of claim 17, further comprising:

configuring each of the ROS shroud and the QSS shroud to have a two-part claim-shell-type construction, the two parts of the given shroud being mirror-symmetric with respect to each other.

25. The sander-casing stockpile of claim 22, wherein each of the ROS shroud and the QSS shroud is a two-part claim-shell-type of arrangement, the two parts of the given shroud being mirror-symmetric with respect to each other.

* * * * *